US009441187B2

(12) United States Patent
Köhle et al.

(10) Patent No.: US 9,441,187 B2
(45) Date of Patent: Sep. 13, 2016

(54) FABRIC SOFTENER ACTIVE COMPOSITION AND METHOD FOR MAKING IT

(71) Applicant: Evonik Industries AG, Essen (DE)

(72) Inventors: Hans-Jürgen Köhle, Mainhausen (DE); Ulrike Kottke, Linsengericht-Grossenhausen (DE); Dirk Kuppert, Aschaffenburg (DE); Dietmar Träumer, Kahl am Main (DE); Kurt Seidel, Jossgrund (DE); Axel Euler, Flieden (DE)

(73) Assignee: Evonik Degussa GmbH, Essen (DE)

( * ) Notice: Subject to any disclaimer, the term of this patent is extended or adjusted under 35 U.S.C. 154(b) by 0 days.

(21) Appl. No.: 14/398,962

(22) PCT Filed: Apr. 24, 2013

(86) PCT No.: PCT/EP2013/058427

§ 371 (c)(1),
(2) Date: Nov. 4, 2014

(87) PCT Pub. No.: WO2013/167376

PCT Pub. Date: Nov. 14, 2013

(65) Prior Publication Data

US 2015/0080286 A1 Mar. 19, 2015

(30) Foreign Application Priority Data

May 7, 2012 (EP) ..... 12166976

(51) Int. Cl.

| | |
|---|---|
| ***C11D 1/62*** | (2006.01) |
| ***C11D 3/00*** | (2006.01) |
| ***C11D 3/20*** | (2006.01) |
| ***C11D 3/33*** | (2006.01) |

(52) U.S. Cl.

CPC ..... *C11D 3/001* (2013.01); *C11D 1/62* (2013.01); *C11D 3/201* (2013.01); *C11D 3/33* (2013.01)

(58) Field of Classification Search

CPC ..... C11D 1/62; C11D 3/001
USPC ..... 510/515
See application file for complete search history.

(56) References Cited

U.S. PATENT DOCUMENTS

| | | | |
|---|---|---|---|
| 4,234,627 | A | 11/1980 | Schilling |
| 4,514,461 | A | 4/1985 | Woo |
| 4,747,880 | A | 5/1988 | Berrido et al. |
| RE32,713 | E | 7/1988 | Woo |
| 4,789,491 | A | 12/1988 | Chang et al. |
| 4,882,220 | A | 11/1989 | Ono et al. |
| 4,917,920 | A | 4/1990 | Ono et al. |
| 4,954,285 | A | 9/1990 | Wierenga et al. |
| 5,002,681 | A | 3/1991 | Wierenga et al. |
| 5,137,646 | A | 8/1992 | Schmidt et al. |
| 5,185,088 | A | 2/1993 | Hartman et al. |
| 5,391,325 | A | 2/1995 | Swenson et al. |
| 5,427,697 | A | 6/1995 | Swartley |
| 5,474,691 | A | 12/1995 | Severns |
| 5,476,599 | A | 12/1995 | Rusche et al. |
| 5,480,567 | A | 1/1996 | Lam et al. |
| 5,703,029 | A | 12/1997 | Crass et al. |
| 5,759,990 | A | 6/1998 | Wahl et al. |
| 5,792,219 | A | 8/1998 | Hartman et al. |
| 5,827,451 | A | 10/1998 | Cummings et al. |
| 5,830,845 | A | 11/1998 | Trinh et al. |
| 5,877,145 | A | 3/1999 | Wahl et al. |
| 5,916,863 | A | 6/1999 | Iacobucci et al. |
| 6,004,913 | A | 12/1999 | Iacobucci et al. |
| 6,037,315 | A | 3/2000 | Franklin et al. |
| 6,180,593 | B1 | 1/2001 | Fender et al. |
| 6,180,594 | B1 | 1/2001 | Fender et al. |
| 6,200,949 | B1 | 3/2001 | Reijmer et al. |
| 6,235,914 | B1 | 5/2001 | Steiger et al. |
| 6,255,274 | B1 | 7/2001 | Becherer et al. |
| 6,376,455 | B1 | 4/2002 | Friedli et al. |
| 6,458,343 | B1 | 10/2002 | Zeman et al. |
| 6,492,322 | B1 | 12/2002 | Cooper et al. |
| 6,608,024 | B1 | 8/2003 | DuVal et al. |
| 6,645,479 | B1 | 11/2003 | Shefer et al. |
| 6,653,275 | B1 | 11/2003 | Fender et al. |
| 6,770,608 | B2 | 8/2004 | Franklin et al. |
| 6,878,684 | B2 | 4/2005 | Ellson et al. |
| 6,897,194 | B2 | 5/2005 | Fan et al. |
| 6,987,074 | B2 | 1/2006 | Ishii et al. |
| 6,995,131 | B1 | 2/2006 | Frankenbach et al. |
| 7,572,761 | B2 | 8/2009 | Gefvert |
| 7,704,940 | B2 | 4/2010 | Boerefijn et al. |
| 7,994,110 | B2 | 8/2011 | Wenk et al. |
| 8,183,199 | B2 | 5/2012 | Fossum et al. |
| 8,361,953 | B2 | 1/2013 | Nagy et al. |
| 8,507,425 | B2 | 8/2013 | Schick et al. |
| 8,563,499 | B2 | 10/2013 | Köhle et al. |
| 8,569,224 | B2 | 10/2013 | Köhle et al. |
| 8,883,712 | B2 | 11/2014 | Köhle et al. |
| 8,883,713 | B2 | 11/2014 | Parrish et al. |
| 2002/0032146 | A1 | 3/2002 | Schaumann et al. |

(Continued)

FOREIGN PATENT DOCUMENTS

| | | |
|---|---|---|
| CA | 1312619 | 1/1993 |
| CS | 246532 | 3/1986 |

(Continued)

OTHER PUBLICATIONS

English translation of the International Search Report for corresponding international application PCT/EP2013/058427 filed Apr. 24, 2013.

(Continued)

*Primary Examiner* — John Hardee
(74) *Attorney, Agent, or Firm* — Law Office of: Michael A. Sanzo, LLC

(57) ABSTRACT

Reacting at least one tris-(2-hydroxyethyl)-amine fatty acid ester with dimethylsulfate at a molar ratio of dimethylsulfate to amine nitrogen of from 0.79 to 0.94 until the reaction mixture has a total amine number of from 7 to 20 mg KOH/g provides novel fabric softener active compositions with a low content of methanol, comprising from 65 to 98% by weight of tris-(2-hydroxyethyl)-methylammonium methylsulfate fatty acid esters and from 1 to 1500 ppm methanol.

14 Claims, No Drawings

(56) References Cited

U.S. PATENT DOCUMENTS

| | | | |
|---|---|---|---|
| 2003/0060390 | A1 | 3/2003 | Demeyere et al. |
| 2003/0139313 | A1 | 7/2003 | Turner et al. |
| 2003/0158344 | A1 | 8/2003 | Rodrigues et al. |
| 2003/0165692 | A1 | 9/2003 | Koch et al. |
| 2003/0195130 | A1 | 10/2003 | Lentsch et al. |
| 2003/0195133 | A1 | 10/2003 | Shefer et al. |
| 2003/0203829 | A1 | 10/2003 | Shefer et al. |
| 2003/0215417 | A1 | 11/2003 | Uchiyama et al. |
| 2003/0216282 | A1 | 11/2003 | Martens et al. |
| 2003/0216488 | A1 | 11/2003 | Uchiyama et al. |
| 2003/0220210 | A1 | 11/2003 | DuVal et al. |
| 2004/0071742 | A1 | 4/2004 | Popplewell et al. |
| 2004/0071746 | A1 | 4/2004 | Popplewell et al. |
| 2004/0072719 | A1 | 4/2004 | Bennett et al. |
| 2004/0072720 | A1 | 4/2004 | Brain et al. |
| 2004/0087477 | A1 | 5/2004 | Ness |
| 2004/0106536 | A1 | 6/2004 | Mane et al. |
| 2004/0167056 | A1 | 8/2004 | Lentsch et al. |
| 2004/0204337 | A1 | 10/2004 | Corona et al. |
| 2005/0014672 | A1 | 1/2005 | Arif |
| 2005/0032671 | A1 | 2/2005 | Kvita et al. |
| 2006/0089293 | A1 | 4/2006 | Frankenbach |
| 2006/0094639 | A1 | 5/2006 | Martin et al. |
| 2006/0142175 | A1 | 6/2006 | Haiss et al. |
| 2006/0252669 | A1 | 11/2006 | Heibel et al. |
| 2006/0277689 | A1 | 12/2006 | Hubig et al. |
| 2007/0054835 | A1 | 3/2007 | Corona et al. |
| 2007/0066510 | A1 | 3/2007 | Tee et al. |
| 2007/0179080 | A1 | 8/2007 | Gallotti |
| 2007/0219111 | A1 | 9/2007 | Ward et al. |
| 2008/0242584 | A1 | 10/2008 | Wahl et al. |
| 2008/0263780 | A1 | 10/2008 | Declercq et al. |
| 2008/0289116 | A1 | 11/2008 | Young et al. |
| 2009/0124533 | A1 | 5/2009 | Kottke et al. |
| 2009/0181877 | A1 | 7/2009 | McGinnis et al. |
| 2011/0110993 | A1 | 5/2011 | Chieffi et al. |
| 2011/0239377 | A1 | 10/2011 | Fossum et al. |
| 2011/0239378 | A1 | 10/2011 | Fossum et al. |
| 2011/0245140 | A1 | 10/2011 | Demeyere |
| 2012/0021959 | A1 | 1/2012 | Morgan, III et al. |
| 2012/0328790 | A1 | 12/2012 | Nagy et al. |

FOREIGN PATENT DOCUMENTS

| | | | |
|---|---|---|---|
| DE | 24 30 140 | A1 | 2/1976 |
| DE | 34 02 146 | A1 | 7/1985 |
| DE | 36 08 093 | A1 | 9/1987 |
| DE | 197 08 133 | | 12/1997 |
| EP | 0 284 036 | | 9/1988 |
| EP | 0 293 955 | A2 | 12/1988 |
| EP | 0 302 567 | A2 | 2/1989 |
| EP | 0 421 146 | A2 | 9/1990 |
| EP | 0 829 531 | A1 | 3/1998 |
| EP | 1 018 541 | A1 | 7/2000 |
| EP | 1 323 817 | A1 | 12/2001 |
| EP | 1 393 706 | A1 | 3/2004 |
| EP | 1 584 674 | A1 | 10/2005 |
| EP | 1 840 197 | A1 | 2/2007 |
| EP | 1 806 392 | A1 | 7/2007 |
| GB | 2 007 734 | A | 5/1979 |
| GB | 2 039 556 | | 8/1980 |
| WO | WO 91/01295 | | 2/1991 |
| WO | WO 92/18593 | | 10/1992 |
| WO | WO 94/14935 | | 7/1994 |
| WO | WO 94/19439 | | 9/1994 |
| WO | WO 97/42279 | | 11/1997 |
| WO | WO 98/38277 | | 9/1998 |
| WO | WO 00/06678 | | 2/2000 |
| WO | WO 01/32813 | A1 | 5/2001 |
| WO | WO 01/42412 | A1 | 6/2001 |
| WO | WO 2005/037973 | A1 | 4/2005 |
| WO | WO 2005/085404 | A1 | 9/2005 |
| WO | WO 2005/095568 | A1 | 10/2005 |
| WO | WO 2007/026314 | A2 | 3/2007 |
| WO | WO 2007/125005 | | 11/2007 |
| WO | WO 2008/003454 | A1 | 1/2008 |
| WO | WO 2008/104509 | | 9/2008 |
| WO | WO 2009/018955 | A2 | 2/2009 |
| WO | WO 2009/099618 | A1 | 8/2009 |
| WO | WO 2011/120836 | A1 | 10/2011 |
| WO | WO 2011/123284 | A1 | 10/2011 |
| WO | WO 2011/123606 | A1 | 10/2011 |
| WO | WO 2011/123733 | A1 | 10/2011 |
| WO | WO 2012/061093 | A1 | 5/2012 |

OTHER PUBLICATIONS

English translation of the Written Opinion of the International Searching Authority for corresponding international application PCT/EP2013/058427 filed Apr. 24, 2013.

English translation of the International Preliminary Report on Patentability for corresponding international application PCT/EP2013/058427 filed Apr. 24, 2013.

European Search Report for EP 12 16 6976 (priority application of PCT/EP2013/058427) filed May 7, 2012.

European Search Report for Application EP 13 19 1579 (priority EP application of copending U.S. Appl. No. 14/531,507, filed Nov. 5, 2013).

XP-002721964; English language abstract for JP 2013133547 dated Aug. 12, 2013.

Akram, et al., "Synthesis of Tallow Based Esterquat," *J Sci Res vol. XXX(1)*:31-36 (Jun. 2010).

Price-Jones, et al., "N,N'-ethylenediyl-bis-alkanamides: Differential scanning calorimetry studies," *J. Am. Oil Chem. Soc.* 73:311-319 (Mar. 1996).

Product Advertisement for Tetranyl AO-1, http//kaochemicals-eu.com/213.html, downloaded Jul. 27, 2011.

Ullman's Encyclopedia of Industrial Chemistry; Wiley-VCH Verlag GmbH & Co. KGaA, Weinheim, vol. 14, Table 2, p. 77 (2012).

U.S. Appl. No. 14/531,507, filed Nov. 3, 2014, Köhle.

FABRIC SOFTENER ACTIVE COMPOSITION AND METHOD FOR MAKING IT

CROSS REFERENCE TO RELATED APPLICATIONS

The present application is US national stage of international application PCT/EP2013/058427, which had an international filing date of Apr. 24, 2013. Priority is claimed to European application EP 12166976.6, filed on May 7, 2012. These related applications are hereby incorporated by reference.

The present invention relates to fabric softener active compositions comprising tris-(2-hydroxyethyl)-methylammonium methylsulfate fatty acid esters and having a low content of methanol and to a method for making such compositions.

Quaternary ammonium salts carrying two hydrophobic long chain hydrocarbon moieties have found broad use as fabric softener actives. Quaternary ammonium salts of alkanolamines esterified with on average two fatty acid moieties per molecule, commonly referred to as ester quats, have largely replaced earlier alkyl quaternary ammonium compounds because of their biodegradability.

Tris-(2-hydroxyethyl)-methylammonium methylsulfate fatty acid esters made by quaternizing fatty acid esters of triethanolamine with dimethylsulfate have found broad use as fabric softener actives. Since dimethylsulfate is a potential carcinogen, quaternization is carried out to achieve complete conversion of dimethylsulfate and a high conversion of amine. It has now been found that tris-(2-hydroxyethyl)-methylammonium methylsulfate fatty acid esters made this way contain unexpectedly high amounts of methanol. Although tris-(2-hydroxyethyl)-methylammonium methylsulfate fatty acid ester softener actives have been in use for more than 20 years, the high content of methanol in these compositions has up to now remained unnoticed.

Since methanol is toxic and presents a workplace hazard, there is therefore a need to provide fabric softener active compositions comprising tris-(2-hydroxyethyl)-methylammonium methylsulfate fatty acid esters which compositions have a low content of methanol. There is also a need for a simple method for making such compositions.

It has now been found that fabric softener active compositions comprising tris-(2-hydroxyethyl)-methylammonium methylsulfate fatty acid esters and having a low content of methanol can be made by reacting fatty acid esters of triethanolamine with dimethylsulfate at reaction conditions where a higher total amine value than in prior art methods is achieved at complete dimethylsulfate conversion.

The present invention is therefore directed to a fabric softener active composition, comprising a) from 65 to 98% by weight of at least one tris-(2-hydroxyethyl)-methylammonium methylsulfate fatty acid ester, b) at least one tris-(2-hydroxyethyl)-amine fatty acid ester in an amount providing a total amine number of the composition of from 7 to 20 mg KOH/g, and c) from 1 to 1500 ppm methanol.

The invention is further directed to a method for making a fabric softener active composition comprising from 65 to 98% by weight of tris-(2-hydroxyethyl)-methylammonium methylsulfate fatty acid esters and from 1 to 1500 ppm methanol, wherein at least one tris-(2-hydroxyethyl)-amine fatty acid ester is reacted with dimethylsulfate at a molar ratio of dimethylsulfate to amine nitrogen of from 0.79 to 0.94 until the reaction mixture has a total amine number of from 7 to 20 mg KOH/g.

The fabric softener active composition of the invention comprises from 65 to 98% by weight of at least one tris-(2-hydroxyethyl)-methylammonium methylsulfate fatty acid ester. The composition further comprises at least one tris-(2-hydroxyethyl)-amine fatty acid ester in an amount providing a total amine number of the composition of from 7 to 20 mg KOH/g, preferably from 8 to 13 mg KOH/g and more preferably from 9 to 12 mg KOH/g. The total amine number is determined by non-aqueous titration with perchloric acid according to method Tf 2a-64 of the American Oil Chemists Society and is calculated as mg KOH per g sample.

The fatty acid moiety of the tris-(2-hydroxyethyl)-methylammonium methylsulfate fatty acid ester can be derived from a pure fatty acid or a mixture of fatty acids of formula RCOOH, where R is a hydrocarbon group. The hydrocarbon group may be branched or unbranched and preferably is unbranched. The fatty acid moiety of the tris-(2-hydroxyethyl)-amine fatty acid ester may be derived from the same or a different fatty acid or mixture of fatty acids. Preferably, the tris-(2-hydroxyethyl)-methylammonium methylsulfate fatty acid esters and the tris-(2-hydroxyethyl)-amine fatty acid esters have the same fatty acid moieties.

The tris-(2-hydroxyethyl)-methylammonium methylsulfate fatty acid ester may comprise monoesters of formula $CH_3N^+(CH_2CH_2OH)_2(CH_2CH_2OC(=O)R)\ CH_3OSO_3^-$, diesters of formula $CH_3N^+(CH_2CH_2OH)\ (CH_2CH_2OC(=O)R)_2\ CH_3OSO_3^-$, and triesters of formula $CH_3N^+(CH_2CH_2OC(=O)R)_3\ CH_3OSO_3^-$, where R is the hydrocarbon group of a fatty acid moiety RCOO. The tris-(2-hydroxyethyl)-methylammonium methylsulfate fatty acid ester preferably has an average molar ratio of fatty acid moieties to nitrogen of from 1.4 to 2.0 and more preferably of from 1.5 to 1.8. The specified molar ratio provides high softening performance in a rinse cycle fabric softener.

The fatty acids corresponding to the fatty acid moieties of said tris-(2-hydroxyethyl)-methylammonium methylsulfate fatty acid esters preferably have an iodine value of from 0.5 to 120, more preferably from 1 to 50 and most preferably from 30 to 45. The iodine value is the amount of iodine in g consumed by the reaction of the double bonds of 100 g of fatty acid, determined by the method of ISO 3961.

The fatty acid moieties of the tris-(2-hydroxyethyl)-methylammonium methylsulfate fatty acid esters preferably have an average chain length of from 16 to 18, more preferably of from 16.5 to 17.8 carbon atoms. The average chain length is calculated on the basis of the weight fraction of individual fatty acids in the mixture of fatty acids. For branched chain fatty acids the chain length refers to the longest consecutive chain of carbon atoms.

The preferred iodine values and average chain lengths provide a suitable combination of good processability of the fabric softener composition in terms of melting point and viscosity and high fabric softening efficiency in a rinse cycle fabric softener.

In order to provide the required average chain length and iodine value, the fatty acid moiety can be derived from a mixture of fatty acids comprising both saturated and unsaturated fatty acids. The unsaturated fatty acids are preferably monounsaturated fatty acids. The tris-(2-hydroxyethyl)-methylammonium methylsulfate fatty acid ester preferably comprises less than 10% by weight of multiply unsaturated fatty acid moieties and more preferably less than 6% by weight. Examples of suitable saturated fatty acids are palmitic acid and stearic acid. Examples of suitable monounsaturated fatty acids are oleic acid and elaidic acid. The cis-trans-ratio of double bonds of unsaturated fatty acid moieties is preferably higher than 55:45 and more preferably higher than 65:35. The fraction of multiply unsaturated fatty acid moieties may be reduced by selective touch hydrogenation, which is a hydrogenation that selectively hydrogenates one double bond in a —CH=CH—$CH_2$—CH=CH— substructure but not double bonds of monounsaturated hydrocarbon groups.

The fabric softener active composition of the invention also comprises from 1 to 1500 ppm methanol and preferably from 10 to 800 ppm methanol, based on the weight of the composition. This methanol content is lower than in prior art fabric softener compositions containing a similar amount of tris-(2-hydroxyethyl)-methylammonium methylsulfate fatty acid esters made by reacting a tris-(2-hydroxyethyl)-amine fatty acid ester with dimethylsulfate. The methanol content of the composition can be determined by head space GLC analysis with calibration by spiking with known amounts of methanol. The fabric softener composition is preferably diluted with a suitable solvent, such as dimethylformamide, to reduce the viscosity for accurate head space GLC analysis. The lower content of methanol in the fabric softener active composition of the invention reduces the need for work safety precautions and the requirements for product labelling and classification and increases the flash point of the composition compared to prior art compositions.

The fabric softener active composition of the invention may further comprise one or more additional organic solvents. The composition preferably comprises up to 35% by weight of a solvent selected from ethanol, 1-propanol, 2-propanol, ethylene glycol, diethylene glycol, propylene glycol, dipropylene glycol, $C_1$-$C_4$-alkyl monoethers of ethylene glycol and $C_1$-$C_4$-alkyl monoethers of propylene glycol. The amount of additional solvent is most preferably from 5 to 20% by weight. The more preferred solvents are ethanol, 1-propanol and 2-propanol, most preferably ethanol or 2-propanol and in particular 2-propanol.

The fabric softener active composition of the invention can be prepared by the method of the invention, where at least one tris-(2-hydroxyethyl)-amine fatty acid ester is reacted with dimethylsulfate at a molar ratio of dimethylsulfate to amine nitrogen of from 0.79 to 0.94 until the reaction mixture has a total amine number of from 7 to 20 mg KOH/g. The total amine number can be determined by non-aqueous titration with perchloric acid according to method Tf 2a-64 of the American Oil Chemists Society and is calculated as mg KOH per g sample. The reaction can be terminated by lowering the temperature once the desired total amine number in this range has been reached. Preferably, the reaction is continued until substantially all of the dimethylsulfate has reacted.

Choosing a molar ratio of dimethylsulfate to amine nitrogen in the specified range and carrying out the reaction until a total amine number of from 7 to 20 mg KOH/g has been reached provides high conversion of dimethylsulfate and at the same time avoids the formation of methanol in amounts exceeding 1500 ppm.

The molar ratio of dimethylsulfate to amine nitrogen is preferably chosen in the range from 0.85 to 0.90. The tris-(2-hydroxyethyl)-amine fatty acid esters are preferably reacted with dimethylsulfate at a temperature of from 60 to 95° C., more preferably from 70 to 90° C. The reaction is preferably carried out until the reaction mixture has a total amine number of from 8 to 13 mg KOH/g, most preferably of from 9 to 12 mg KOH/g. The tris-(2-hydroxyethyl)-amine fatty acid ester may be reacted with dimethylsulfate at any pressure, such as ambient pressure or reduced pressure. The reaction of the tris-(2-hydroxyethyl)-amine fatty acid ester with dimethylsulfate may be carried out in the presence of an additional solvent, but is preferably carried out without addition of a solvent.

The tris-(2-hydroxyethyl)-amine fatty acid esters used in the method of the invention preferably have an average molar ratio of fatty acid moieties to nitrogen of from 1.4 to 2.0 and more preferably of from 1.5 to 1.8. The fatty acid moieties of the tris-(2-hydroxyethyl)-amine fatty acid esters preferably have an iodine value of from 0.5 to 120 and more preferably of from 1 to 50. The fatty acid moieties of the tris-(2-hydroxyethyl)-amine fatty acid esters preferably have an average chain length of from 16 to 18 and more preferably from 16.5 to 17.8 carbon atoms.

The tris-(2-hydroxyethyl)-amine fatty acid ester starting material is preferably prepared by esterifying triethanolamine with a fatty acid or fatty acid mixture, removing the water formed during esterification at reduced pressure. The tris-(2-hydroxyethyl)-amine fatty acid esters made this way can be used without further purification. The desired iodine value, average chain length and molar ratio of fatty acid moieties to nitrogen may be easily adjusted by the choice of fatty acid or fatty acid mixture and the molar ratio of triethanolamine to fatty acid used in the esterification reaction. The esterification is preferably carried out at a temperature of from 160-210° C. at ambient pressure distilling off water until 60 to 80% of the theoretical amount of water has been removed. Then the pressure is reduced stepwise to a final pressure in the range of 20 to 50 mbar and the reaction is continued until an acid value of 1 to 10 mg KOH/g, more preferably 2 to 5 mg KOH/g, has been reached.

The invention is illustrated by the following examples, which are however not intended to limit the scope of the invention in any way.

EXAMPLES

Example 1

Methanol Content of Commercial Tris-(2-Hydroxyethyl)-Methylammonium Methylsulfate Tallow Fatty Acid Esters Table 1 shows methanol contents of commercial tris-(2-hydroxyethyl)-methylammonium methylsulfate tallow fatty acid esters determined by head space GC.

TABLE 1

Methanol content of commercial tris-(2-hydroxyethyl)-methylammonium methylsulfate tallow fatty acid esters

| Manufacturer | Product name | Methanol content in ppm |
|---|---|---|
| Clariant | Praepagen ® TQ | 7000 |
| Stepan | Stepantex ® VA 90 | 3300 |
| Stepan | Stepantex ® VL 85 G | 3800 |
| Stepan | Stepantex ® VK 90 | 3800 |
| Cognis | Dehyquart ® AU 46 | 6100 |
| Cognis | Dehyquart ® AU 57 | 5700 |
| Kao | Tetranyl ® AT 1 | 4600 |
| Rewo | Rewoquat ® V 3620 | 3000 |

Example 2

Preparation of Tris-(2-Hydroxyethyl)-Amine Tallow Fatty Acid Ester

A mixture of 3513 g (12.82 mol) tallow fatty acid having an iodine value of 38 and 1115 g (7.47 mol) triethanolamine was heated to 190° C. with stirring, distilling off water from the reaction mixture. After 2 h at this temperature the pressure was reduced stepwise to 20 mbar and the mixture was stirred another 3 h at 190° C. and 20 mbar. Thereafter, the reaction mixture was cooled to 60° C. The resulting tris-(2-hydroxyethyl)-amine tallow fatty acid ester had an acid value of 3.6 mg KOH/g and a total amine number of 95.2 mg KOH/g.

Preparation of Tris-(2-Hydroxyethyl)-Methylammonium Methylsulfate Tallow Fatty Acid Ester Example 3

167.7 g (1.33 mol) dimethylsulfate was added in small portions with stirring to 818 g (1.387 mol) tris-(2-hydroxyethyl)-amine tallow fatty acid ester from example 2, cooling the reaction mixture to maintain the temperature in the range from 70 to 90° C. After all dimethylsulfate had been added, the reaction mixture was stirred for 1 h at 80 to 90° C. Then 109.5 g 2-propanol was added and the mixture was stirred until homogeneous. The resulting composition had a total amine number of 3.4 mg KOH/g and contained 4450 ppm methanol, based on the weight of the composition.

Example 4

Example 3 was repeated using 160.44 g (1.272 mol) dimethylsulfate, 808.8 g (1.369 mol) tris-(2-hydroxyethyl)-amine tallow fatty acid ester from example 2, and 107.47 g 2-propanol. The resulting composition had a total amine number of 6.0 mg KOH/g and contained 3000 ppm methanol, based on the weight of the composition.

Example 5

Example 3 was repeated using 144.55 g (1.146 mol) dimethylsulfate, 755.4 g (1.282 mol) tris-(2-hydroxyethyl)-amine tallow fatty acid ester from example 2 and 100.0 g 2-propanol. The resulting composition had a total amine number of 8.9 mg KOH/g and contained 1400 ppm methanol, based on the weight of the composition.

Example 6

Example 3 was repeated using 135.1 g (1.072 mol) dimethylsulfate, 780.1 g (1.324 mol) tris-(2-hydroxyethyl)-amine tallow fatty acid ester from example 2 and 102.0 g 2-propanol. The resulting composition had a total amine number of 17.2 mg KOH/g and contained 155 ppm methanol, based on the weight of the composition.

Examples 3 and 4 (not according to the invention) and examples 5 and 6 (according to the invention) demonstrate how the methanol content of fabric softener composition can be controlled by chosing the right molar ratio of tris-(2-hydroxyethyl)-amine fatty acid ester to dimethylsulfate and carrying out quaternization to a total amine number of the reaction mixture of from 7 to 20 mg KOH/g.

Example 7

Comparative

The preparation of di(acyloxyethyl)(2-hydroxyethyl) methyl ammonium methylsulfate with acyl groups derived from partially hydrogenated canola fatty acid described in column 43 lines 37 to 53 of U.S. Pat. No. 6,995,131 was repeated. The resulting composition contained 5500 ppm methanol, based on the weight of the composition.

The invention claimed is:

1. A fabric softener active composition, comprising:

a) from 65 to 98% by weight of at least one tris-(2-hydroxyethyl)-methylammonium methylsulfate fatty acid ester, b) at least one tris-(2-hydroxyethyl)-amine fatty acid ester in an amount providing a total amine number of the composition of from 7 to 20 mg KOH/g, and c) from 1 to 1500 ppm methanol.

2. The fabric softener active composition of claim 1, comprising from 10 to 800 ppm methanol.

3. The fabric softener active composition of claim 1, comprising said tris-(2-hydroxyethyl)-amine fatty acid esters in an amount providing a total amine number of the composition of from 8 to 13 mg KOH/g.

4. The fabric softener active composition of claim 1, wherein said tris-(2-hydroxyethyl)-methylammonium methylsulfate fatty acid esters and said tris-(2-hydroxyethyl)-amine fatty acid esters have the same fatty acid moieties.

5. The fabric softener active composition of claim 1, wherein said tris-(2-hydroxyethyl)-methylammonium methylsulfate fatty acid esters have an average molar ratio of fatty acid moieties to nitrogen of from 1.4 to 2.0.

6. The fabric softener active composition of claim 1, wherein the fatty acids corresponding to the fatty acid moieties of said tris-(2-hydroxyethyl)-methylammonium methylsulfate fatty acid esters have an iodine value of from 0.5 to 120.

7. The fabric softener active composition of claim 1, wherein the fatty acid moieties of said tris-(2-hydroxyethyl)-methylammonium methylsulfate fatty acid esters have an average chain length of from 16 to 18 carbon atoms.

8. The fabric softener active composition of claim 1, wherein said tris-(2-hydroxyethyl)-methylammonium methylsulfate fatty acid esters comprise less than 10 mol-% polyunsaturated fatty acid moieties.

9. The fabric softener active composition of claim 1, further comprising up to 35% by weight of a solvent selected from the group consisting of ethanol, 1-propanol, 2-propanol, ethylene glycol, diethylene glycol, propylene glycol, dipropylene glycol, $C_1$-$C_4$-alkyl monoethers of ethylene glycol and $C_1$-$C_4$-alkyl monoethers of propylene glycol.

10. A method for making a fabric softener active composition comprising from 65 to 98% by weight of tris-(2-hydroxyethyl)-methylammonium methylsulfate fatty acid esters and from 1 to 1500 ppm methanol, wherein at least one tris-(2-hydroxyethyl)-amine fatty acid ester is reacted with dimethylsulfate at a molar ratio of dimethylsulfate to amine nitrogen of from 0.79 to 0.94 until the reaction mixture has a total amine number of from 7 to 20 mg KOH/g.

11. The method of claim 10, wherein said tris-(2-hydroxyethyl)-amine fatty acid esters are reacted with dimethylsulfate at a temperature of from 60 to 95° C.

12. The method of claim 10, wherein said tris-(2-hydroxyethyl)-amine fatty acid esters have an average molar ratio of fatty acid moieties to nitrogen of from 1.4 to 2.0.

13. The method of claim 10, wherein the fatty acid moieties of said tris-(2-hydroxyethyl)-amine fatty acid esters have an iodine value of from 0.5 to 120.

14. The method of claim 10 wherein the fatty acid moieties of said tris-(2-hydroxyethyl)-amine fatty acid esters have an average chain length of from 16 to 18 carbon atoms.

* * * * *